United States Patent [19]

Lienau

[11] 4,095,508

[45] Jun. 20, 1978

[54] CAPACITIVE DISCHARGE FIRING MECHANISM

[75] Inventor: Jeffrey A. Lienau, Huntsville, Ala.

[73] Assignee: The United States of America as represented by the Secretary of the Army, Washington, D.C.

[21] Appl. No.: 784,106

[22] Filed: Apr. 4, 1977

[51] Int. Cl.[2] ..... F41F 3/04

[52] U.S. Cl. ..... 89/1.814; 89/1.816

[58] Field of Search ..... 89/1.814, 1.813, 1.807, 89/1.8, 1.816, 28 R, 28 A, 135; 102/70.2 A; 42/84

[56] References Cited

U.S. PATENT DOCUMENTS

| | | | |
|---|---|---|---|
| 3,001,477 | 9/1961 | Ruehlemann | 89/28 R X |
| 3,160,795 | 12/1964 | Aune | 89/1.814 UX |
| 3,371,578 | 3/1968 | Choate et al. | 89/1.816 X |
| 3,703,145 | 11/1972 | Burkhardt et al. | 89/1.814 X |
| 3,721,155 | 3/1973 | Stauff et al. | 89/1.814 X |
| 3,736,837 | 6/1973 | Kaprelian et al. | 89/28 R |
| 3,786,717 | 1/1974 | Vickers et al. | 89/1.814 |
| 3,982,347 | 9/1976 | Brandl et al. | 42/84 |

*Primary Examiner*—David H. Brown

*Attorney, Agent, or Firm*—Nathan Edelberg; Robert P. Gibson; James T. Deaton

[57] ABSTRACT

A capacitive discharge firing mechanism for a lightweight portable rocket launcher in which the capacitive discharge firing mechanism includes means for interconnecting electrical circuits for supplying an electrical pulse to a rocket carried in the launcher for ignition of the rocket motor. The means for interconnecting electrical circuits includes three safety type means which prevent accidental actuation of the firing button for the electrical circuit.

10 Claims, 10 Drawing Figures

CAPACITIVE DISCHARGE FIRING MECHANISM

DEDICATORY CLAUSE

The invention described herein may be manufactured, used, and licensed by or for the Government for governmental purposes without the payment to me of any royalties thereon.

BACKGROUND OF THE INVENTION

In recent years there has been developed folding fin stabilized rockets which can be fired by one man from a lightweight portable launcher. The rockets normally have a high explosive warhead and are extremely useful against tanks and vehicles. Since the launcher must be portable, weight is a prime consideration in such launcher design. Additionally, the launcher must have a relatively long shelf life.

The rocket launcher essentially comprises a long thin wall open end tube or barrel which is proportioned to receive a rocket. The launcher may be man transportable and capable of being fired from an individual's shoulder or from other conventional support structures. The tube may be of the telescoping type so as to provide a length which is sufficiently greater than the rocket so that the propellant blast of the rocket will have substantially subsided before the rocket leaves the tube. The rocket firing mechanism, when actuated, closes an electrical circuit thereby effecting discharge of the rocket.

In the past, other rocket firing mechanisms have not always been lightweight and made of solid state materials which lend to a rugged and simple firing mechanism. Also, previously developed firing mechanisms have used many metal parts some of which require machining. Therefore, it can be seen that a simple firing mechanism that can be made from moldable plastic and with a very simple design is needed.

Accordingly, it is an object of this invention to provide a firing mechanism that can be made almost exclusively of moldable plastic parts.

Another object of this invention is to eliminate components by using the same component for multiple functions.

Still another object of this invention is to use a flexible printed circuit for mounting the electrical components and for utilizing switch contacts on a trigger member and an interlock button of the firing mechanism to interconnect with printed circuit leads of the printed circuit to control electrical circuits for the rocket launcher.

Still another object of this invention is to provide a firing mechanism in which is contained a rear sight peep, safety, and a tube interlock.

A still further object of this invention is to provide a firing mechanism that has a safety capable of preventing firing of the rocket when dropped or crushed.

A further object of this invention is to provide a firing mechanism in which a "solid state" battery of conventional structure with long life is used to charge capacitors to supply energy to the rocket launcher to arm the warhead and cause the squib of the rocket motor to be ignited.

Still another object of this invention is to provide a firing mechanism that has two basic subassemblies, mechanical and electrical, each assembly being restricted to parts and manufacturing processes normally available to electrical/mechanical firms.

SUMMARY OF THE INVENTION

In accordance with this invention, a capacitive discharge firing mechanism is provided that includes a rocket launching tube that has two telescoping sections with a cam on the inner section for actuating a pin in the outer section to disengage a firing button interlock from the firing button and actuate a switch contact to connect a battery for charging capacitors. The firing button interlock is contained within the firing mechanism that is mounted on the outer surface of the outer section. A sight gate is pivotally mounted as a part of the firing mechanism and is snapped to an open position to expose a safety and the firing button. The safety is mounted in the firing mechanism housing and slides linearly to allow the firing button to be actuated. The safety has a switch contact thereon that makes contact with printed circuit leads that control the firing of a squib in a missile in the launching tube and the safety switch contact enables the circuit when the safety is actuated to the firing position. The firing button is held in a retracted position by detent means between the firing button and the housing for the firing mechanism and a spring is mounted between the firing button and the housing to bias the firing button in a direction for firing. The firing button has a plurality of switch contacts thereon that make contact with leads of the printed circuit. When the firing button is manually actuated for firing the rocket, the detent means is overcome and the switch contacts on the firing button are biased to and through positions that cause the warhead of the rocket to be armed and the squib of the rocket motor to be ignited by a power supply system mounted to the printed circuit.

DESCRIPTION OF THE PREFERRED EMBODIMENT

Figure 1:
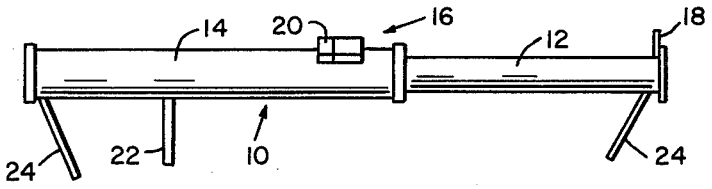
FIG. 1 is a perspective view of a launcher with the firing mechanism according to this invention.
Figure 2:
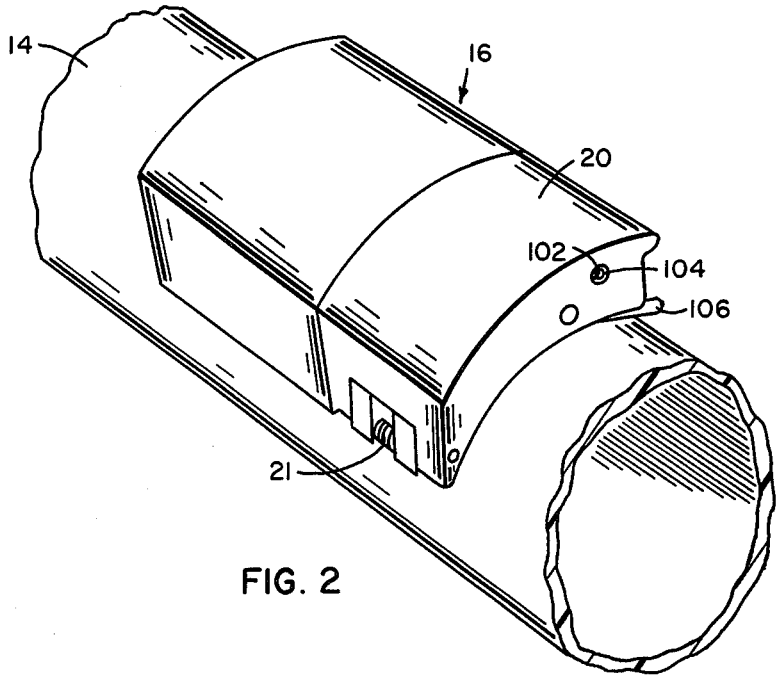
FIG. 2 is a perspective view showing the firing mechanism enlarged with the launcher partially cut away.

Referring now to the drawings, FIG. 1 shows a rocket launcher 10 that has an inner tube 12 and an outer tube 14 that telescope together and as illustrated are in an extended position. Firing mechanism 16 is mounted on the outer surface of tube 14 and includes a rear peep sight and cover device 20 for aligning with sight bead 18 and the launcher with a target. This is accomplished by sighting through opening 104 n pivoted member 106 to align bead 18 with the target. At night member 106 is pivoted clockwise to allow larger opening 102 to be used in aligning bead 18 with the target. A spring 21 (see FIG. 2) biases peep sight and cover member 20 to the sighting position illustrated in FIG. 3 for accomplishing the sighting operation.

Figure 4:
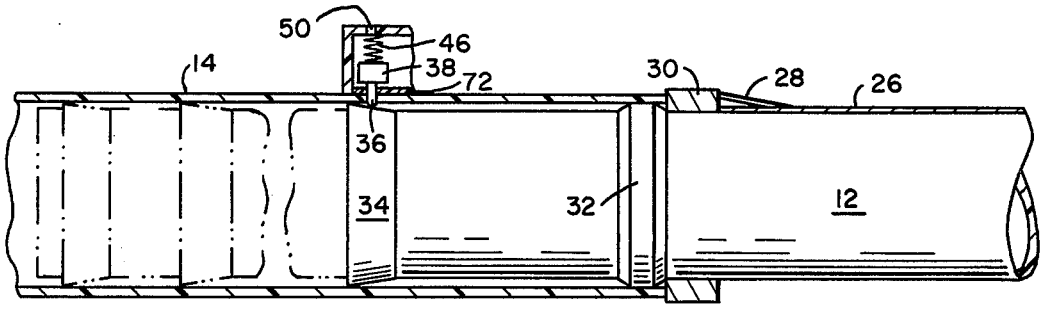
FIG. 4 is a schematic partial sectional view of the launch tube and the firing mechanism illustrating the action of the cam on the inner tube section with the pin that is mounted in the outer tube section.
Figure 9:
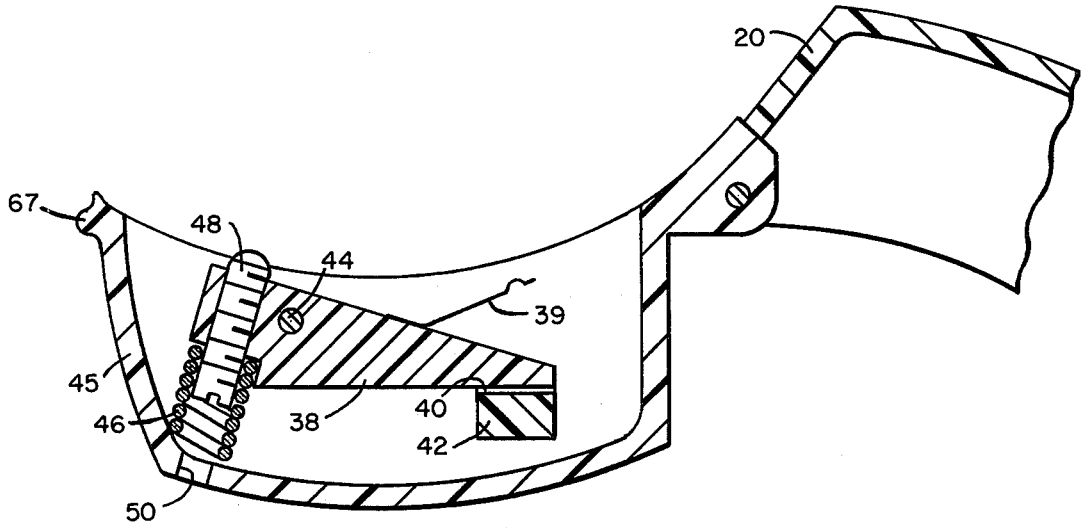
FIG. 9 is a sectional view along line 9—9 of FIG. 6.
Figure 10:
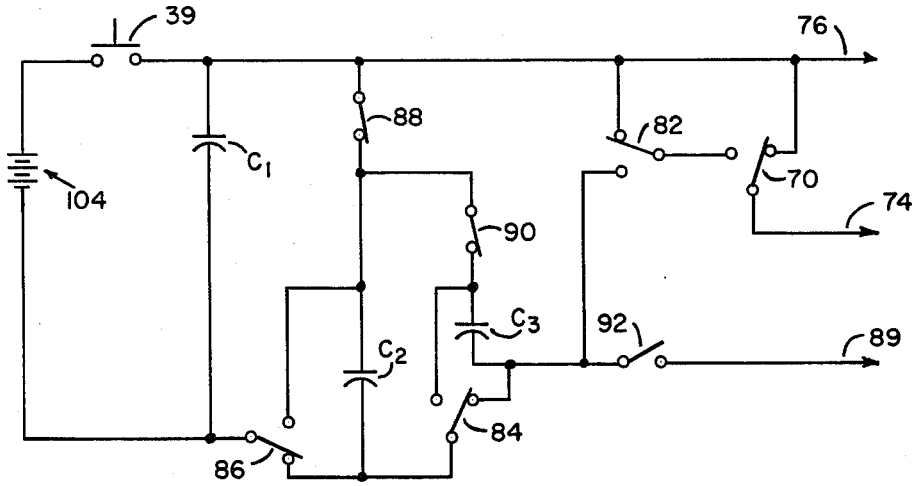
FIG. 10 is a schematic of the printed circuit diagram of FIG. 5.

A shoulder rest 22 is also secured in a conventional manner to tube 14 for resting against the shoulder of one who fires a rocket from the rocket launcher. A strap 24 is also connected to inner and outer tubes 12 and 14 for carrying the rocket launcher. As shown in FIG. 4, inner tube 12 has a guide 26 that slides in a groove of end member 30 of outer tube 14 and spring detent 28 snaps to an outward position as illustrated to lock the inner and outer tubes in an extended position when the inner and outer tubes are moved to the extended position illustrated. Inner member 12 also has cams 32 and 34 mounted thereon for guiding inner member 12 and outer member 14 and for actuating pin 36 to release firing button interlock 38 from groove 40 (see FIG. 6) of firing button 42. Firing button interlock 38 is pivoted at 44 in housing 45 and spring 46 (see FIG. 9) biases firing button interlock 38 into groove 40. Set screw 48 is utilized for providing adjustment between pin 36 and firing button interlock 38. Housing 45 has an opening 50 through which set screw 48 can be adjusted. Firing button interlock 38 has switch contact 39 thereon for electrically interconnecting printed circuit leads 76 and 77 at dashed circle 39 (see FIG. 5) when inner and outer tubes 12 and 14 are actuated into the extended position.

Figure 8:
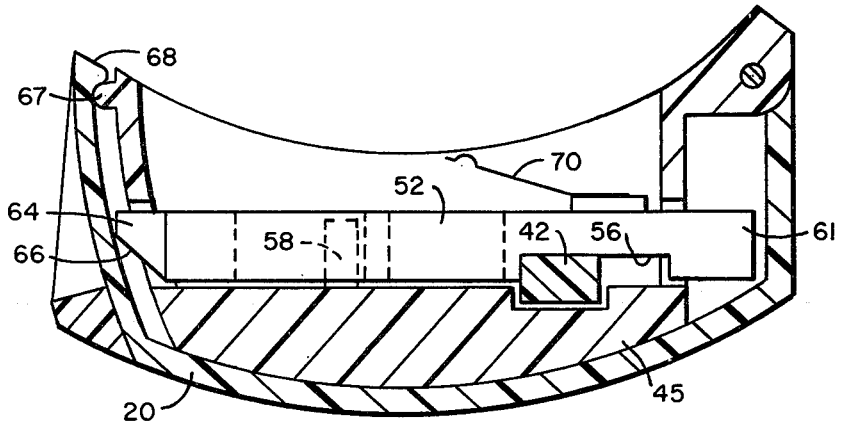
FIG. 8 is a sectional view along line 8—8 of FIG. 6 illustrating the peep sight closure in a closed position.

Housing 45 also slidably mounts firing button 42 therein in a conventional manner and safety 52 (see FIGS. 6 and 8) is slidably mounted in the housing for movement perpendicular to firing button 42 for release of the firing button when desired. Firing button 42 has a second groove 54 (see FIG. 6) therein that safety 52 overlaps and maintains firing button 42 in a safe position until safety 52 is actuated to cause groove 56 (see FIG. 8) of safety 52 to overlap with groove 54 (see FIG. 6) in the firing button. This allows firing button 42 to be moved linearly in housing 45. Safety 52 is maintained in position of safety on or safety off by a pin 58 mounted in the housing and by cutout 60 (see FIG. 6) in safety member 52. When safety 52 is moved from safe position to firing position, protrusions 62 of cutout 60 are snapped past pin 58 to maintain safety 52 in the position to which it is actuated. End 61 (see FIG. 8) of safety 52 is utilized for movement of the safety to a firing position which allows firing button 42 to be actuated. The opposite end 64 of safety 52 has a tapered surface 66 which cooperates with edge 68 of cover 20 to force safety 52 back into a safe position when the rocket has not been fired and it is desired to close cover 20. Bead 67 cooperates with edge 68 to hold cover 20 closed. Safety 52 also has a switch contact 70 mounted thereon which contacts printed circuit leads 74 and 76 (see FIG. 5) of flexible printed circuit 72 at positions 1 and 3 to connect first output lead 74 to ground lead 76 and initially ground the squib for the rocket. When safety 52 is moved to the arming position, switch contact 70 interconnects positions 5 and 7 of leads 74 and 78 to connect first output lead 74 through the squib to the firing circuit. As can be seen, a switch is made of the printed circuit leads 74, 76, and 78 and flexible switch contact 70. Printed circuit 72 is mounted between firing mechanism 16 and outer tube 14 in a conventional manner as illustrated in FIG. 4. That is, printed circuit 72 is bonded to outer tube 14 and housing 45 of firing mechanism 16 is bonded to outer tube 14 and over printed circuit 72.

Figure 7:
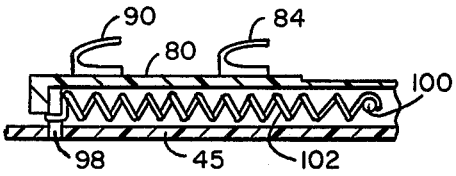
FIG. 7 is a sectional view along line 7—7 of FIG. 6.

Firing button 42 is connected at opposite end 80 (see FIG. 6) for actuating switch contacts 82, 84, 86, 88, 90 and 92 mounted thereon. Firing button 42 has detent means between opposite end 80 and housing 45 that includes projections 94 on end 80 that can be snapped past protrusions 96 of housing 45. Housing 45 (see FIG. 7) has a pin 98 mounted thereon and firing button 42 has pin 100 mounted thereon. Spring 102 is connected in tension between pins 98 and 100 to bias firing button 42 into the firing position.

The power supply system on flexible printed circuit 72 includes a conventional "solid state" type battery 104 connected across leads 77, 79, capacitor $C_1$ connected across leads 76, 79, capacitor $C_2$ connected across leads 81, 83 and capacitor $C_3$ connected across leads 85,87. First output lead 74 is connected to a squib (not shown) of the rocket motor, output lead 76 is a ground lead, and second output lead 89 is connected to a warhead (not shown) of the rocket for arming the warhead. This device is generally used as a one shot device, but can be used for firing many rocket rounds. This is accomplished by opening 47 (see FIG. 6) through housing 45 that allows a pin or tool to be used to push end 80 and snap detent means 94, 96 back into the position illustrated in FIG. 6 after the device has been fired.

Figure 3:
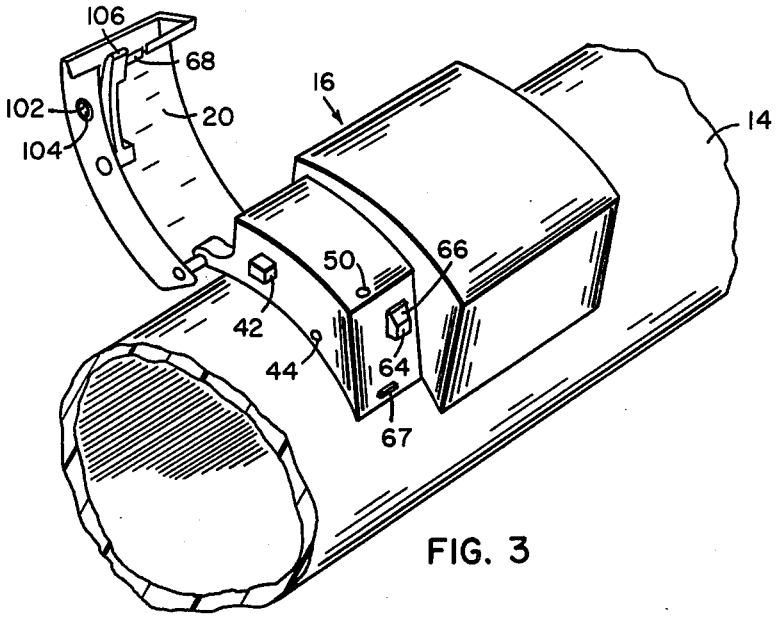
FIG. 3 is another perspective view of the firing mechanism with the peep sight cover in the firing position and illustrating the launching tube partially cut away.
Figure 5:
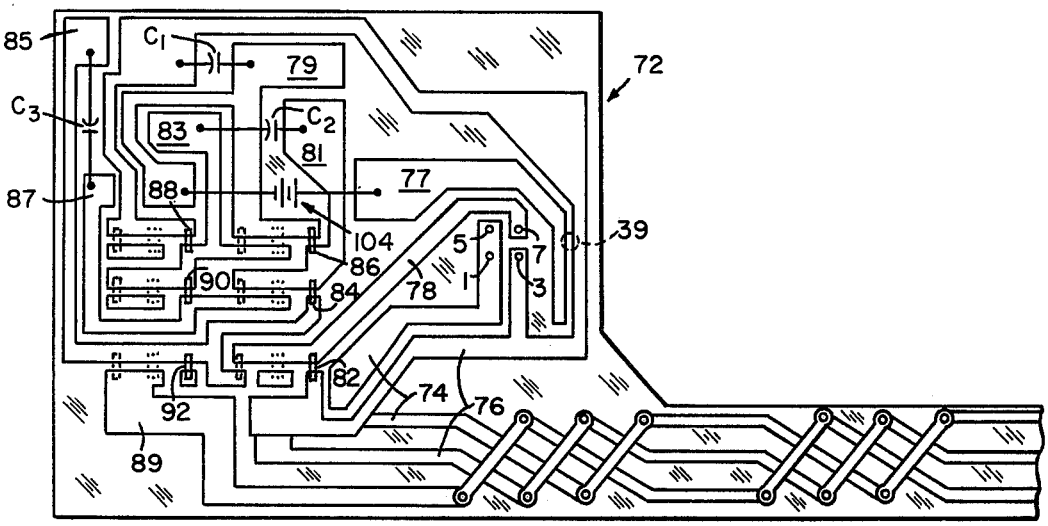
FIG. 5 is a view of a flexible printed circuit in accordance with this invention and schematically illustrating power system components and switch contacts thereon.
Figure 6:
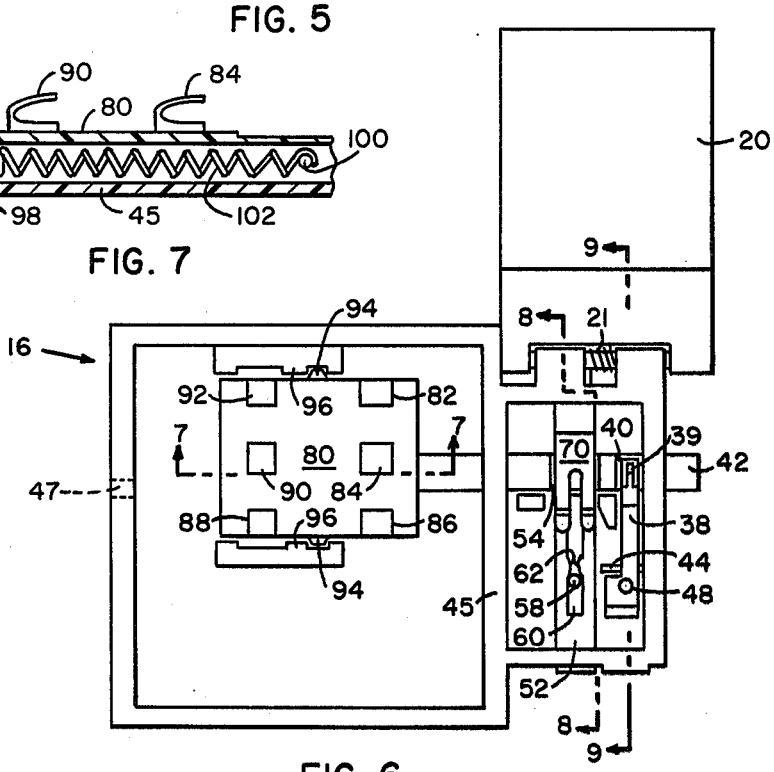
FIG. 6 is a view looking into the firing mechanism with the firing mechanism removed from the launcher in accordance with this invention.

In operation, rocket launcher 10 is normally telescoped into a retracted position and actuated into an extended position as illustrated in FIG. 1. When launch tube 12 is extended relative to tube 14, cam 34 actuates pin 36 (see FIG. 4) against the screw 48 (see FIG. 9) to actuate firing button interlock 38 and disengage firing button interlock 38 from groove 40 in firing button 42 and connect contact 39 across leads 76, 77 (see FIG. 5) to cause capacitors $C_1$, $C_2$ and $C_3$ to be charged in parallel by battery 104. With the firing button interlock 38 released, sight gate 20 is snapped open to release end 68 from bead 67. Spring 21 (see FIG. 2) then biases sight gate 20 to the position for firing as illustrated in FIG. 3. With sight gate cover 20 in the firing or launching position, end 61 (see FIG. 8) of safety 52 can be pushed to release firing button 42 for linear movement. Also, as safety 52 is actuated, switch contact 70 (see FIG. 6) moves from position 1-3 to position 5-7 as illustrated in FIG. 5 to interconnect first output lead 74 with lead 78 to prepare the circuit for squib firing when firing button 42 is actuated. The rocket is now ready for firing and is accomplished by sighting through opening 102 in sight gate 20 or by sighting through opening 104 in pivoted member 106 and aligning the launcher with a target by sighting with bead 18. With the rocket launcher aligned with the target, firing button 42 is actuated to cause the firing button to move linearly relative to printed circuit 72. As firing button 42 is actuated, projections 94 (see FIG. 6) are snapped past protrusions 96 and spring 102 biases the firing button into the firing position. As firing button 42 is actuated to fire the rocket, switch contacts 82, 84, 86, 88, 90 and 92 are actuated from the solid line position illustrated in FIG. 5 to and through the dotted position illustrated and then finally into the dashed line position illustrated. In the dotted line position, capacitors $C_1$, $C_2$ and $C_3$ are connected in series across the warhead (not shown) through output lead 89 to arm the warhead. In the dashed line position, capacitors $C_1$, $C_2$ and $C_3$ are connected across the squib (not shown)

through output lead 74 to cause the rocket motor (not shown) to be ignited and launch the rocket. If the device is used as a one shot device, once the rocket has been launched, the rocket launcher is discarded. If the device is used for multiple rounds, firing button 42 is reset by inserting a tool through opening 47 and resetting the firing button to the position illustrated in FIG. 6. Also, the expended rocket shell that is mounted in launcher 10 is replaced by a new round.

I claim:

1. A discharge firing mechanism for a lightweight portable rocket launcher in which the discharge firing mechanism includes a power supply system on a printed circuit, said power supply system including battery means, capacitors, and appropriate connecting means connecting said battery means and said capacitors to leads of said printed circuit; and a firing button with a plurality of switch contacts mounted in fixed relation thereon and with each of said plurality of said switch contacts in contact with certain of said leads of said printed circuit to supply power to a first output lead of said leads and to a second output lead of said leads of the printed circuit for connecting said power supply system for arming and firing a rocket motor when said switch contacts have been actuated in unison to predetermined positions relative to said leads.

2. A discharge firing mechanism as set forth in claim 1, wherein said plurality of switch contacts are six switch contacts, and wherein said switch contacts engage leads of the printed circuit to supply said power to said second output lead at an intermediate position of said firing button and finally to supply power to said first output lead when said firing button with the contacts have moved to a final firing position relative to the leads of the printed circuot.

3. A discharge firing mechanism as set forth in claim 1, wherein said firing button is mounted in a housing for linear movement therein, wherein detent means is provided between said firing button and said housing for holding said firing button in a predetermined position against a spring biasing means mounted between said housing and said firing button, and wherein safety means are mounted in said housing for preventing actuation of said firing button until said safety means has been actuated to a position for allowing said linear movement of said firing button.

4. A discharge firing mechanism as set forth in claim 3, wherein said appropriate connecting means includes said safety means having a switch contact thereon that makes contact with a pair of said leads on said printed circuit for grounding the first output lead for the rocket motor when said safety means is in a safe position and for interconnecting one of said pair of leads to another of said leads of said printed circuit for interconnecting the first output lead for allowing arming of said rocket motor by said power supply system when the safety means has been moved to a firing position.

5. A discharge firing mechanism as set forth in claim 4, wherein an interlock button is pivotably mounted in said housing and being biased into a groove within said firing button to prevent linear movement of said firing button, and means for actuating said interlock button out of said groove.

6. A discharge firing mechanism as set forth in claim 5, wherein said appropriate connecting means also includes said interlock button having a switch contact thereon that makes contact with two leads of said printed circuit to connect said capacitors in parallel across said battery means when said interlock button has been actuated out of said groove.

7. A discharge firing mechanism as set forth in claim 6, wherein said safety means has a first end which projects outside of said housing and said firing button has an actuating end that projects outside of said housing, and wherein a cover is pivotably mounted on said housing for inclosing said first end and said actuating end when in a closed position and exposing said first end and said actuating end when in an open position.

8. A discharge firing mechanism as set forth in claim 7, wherein said cover is spring biased toward said open position, and wherein said cover has an edge thereon and said housing has means thereon for cooperating with said edge to hold said cover in a closed position.

9. A discharge firing mechanism as set forth in claim 8, wherein said safety means has a second end which projects through said housing and said edge cooperating with said second end of said safety means to move said safety means to a safe position when closing said cover.

10. A discharge firing mechanism as set forth in claim 9, wherein said housing has an opening therein to allow a tool to be inserted through said opening and engage said firing button to move said firing button to a reset position.

* * * * *